US007515162B2

(12) United States Patent
Horii

(10) Patent No.: US 7,515,162 B2
(45) Date of Patent: Apr. 7, 2009

(54) IMAGE FORMING APPARATUS, IMAGE FORMING METHOD AND COMPUTER-READABLE MEDIUM FOR STORING PROGRAM THEREFOR

(75) Inventor: Junichi Horii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 156 days.

(21) Appl. No.: 11/640,321

(22) Filed: Dec. 18, 2006

(65) Prior Publication Data

US 2008/0007583 A1 Jan. 10, 2008

(30) Foreign Application Priority Data

Jul. 10, 2006 (JP) ..... 2006-188966

(51) Int. Cl.
*B41J 2/385* (2006.01)
*G03G 15/00* (2006.01)
*G03G 15/01* (2006.01)

(52) U.S. Cl. ..... 347/116; 399/49; 399/301

(58) Field of Classification Search ..... 347/116; 399/49, 301
See application file for complete search history.

(56) References Cited

U.S. PATENT DOCUMENTS 5,072,244 A * 12/1991 Aoki et al. ..... 347/116
5,963,240 A * 10/1999 Shinohara et al. ..... 347/116
5,995,717 A * 11/1999 Tanaka ..... 358/1.9
6,493,011 B1 * 12/2002 Shioya ..... 347/116
2005/0219329 A1 * 10/2005 Sanada ..... 347/70

FOREIGN PATENT DOCUMENTS

JP A 8-50385 2/1996

* cited by examiner

*Primary Examiner*—Matthew Luu
*Assistant Examiner*—Kendrick X Liu
(74) *Attorney, Agent, or Firm*—Oliff & Berridge, PLC

(57) ABSTRACT

An image forming apparatus includes an input unit that inputs an image forming job, a raster image generating unit, a transport path, a plurality of image forming engines, a calculating unit that calculates the displacement amount between the formation position of the pattern formed by each image forming engine and an ideal formation position thereof, and a controller that supplies each of the plurality of image forming engines with a driving signal instructing formation of a blank image during the time period when the calculated displacement amount is larger than a second threshold value, supplies each of the plurality of image forming engines with a driving signal instructing formation of the image corresponding to each raster image generated by the raster image generating unit and a preset mark when the displacement amount is smaller than the second threshold value.

9 Claims, 6 Drawing Sheets

IMAGE FORMING APPARATUS, IMAGE FORMING METHOD AND COMPUTER-READABLE MEDIUM FOR STORING PROGRAM THEREFOR

BACKGROUND (1) Technical Field

The present invention relates to an image forming apparatus, an image forming method and a computer-readable medium for storing a program for the image forming apparatus, and particularly to an image forming apparatus and a method for forming an image on continuous paper as a recording material and a computer-readable medium for storing a program for the image forming apparatus.

(2) Related Art

According to an electrophotographic image forming apparatus, toner images of cyan, magenta, yellow and black are superposed on one another by using four image forming engines of cyan, magenta, yellow and black to implement formation of a full color image. In order to achieve a desired full color image by superposing these four color toner images, it is necessary that the respective color toner images are transferred to the same position on the recording material. If the transfer position of any one or plural colors is displaced from that of the other colors, that is, a so-called registration displacement occurs.

SUMMARY

According to an aspect of the present invention, there is provided an image forming apparatus including: an input unit that inputs an image forming job; a raster image generating unit that interprets the input image forming job and successively generates a set of raster images of respective colors; a transport path along which continuous paper is transported; a plurality of image forming engines each of which is individually driven in accordance with a driving signal supplied thereto to successively form each color image on the surface of the continuous paper transported along the transport path and form a pattern indicating a position as a reference for image formation so that the pattern is not overlapped with the image; a calculating unit that calculates the displacement amount between the formation position of the pattern formed by each image forming engine and an ideal formation position thereof; and a controller that supplies each of the plurality of image forming engines with a driving signal instructing formation of a blank image during the time period when the calculated displacement amount is larger than a second threshold value, supplies each of the plurality of image forming engines with a driving signal instructing formation of the image corresponding to each raster image generated by the raster image generating unit and a preset mark when the displacement amount is smaller than the second threshold value, and supplies each of the plurality of image forming engines with a driving signal instructing formation of the image corresponding to each raster image generated by the raster image generating unit when the displacement amount is smaller than a first threshold value that is smaller than the first threshold value.

BRIEF DESCRIPTION OF THE DRAWING

Exemplary embodiments of the invention will be described in detail based on the following figures, wherein.

DETAILED DESCRIPTION

Exemplary embodiments of the present invention will be described with reference to the accompanying drawings.

An image forming apparatus according to this exemplary embodiment has the following three features.

A first feature is as follows. Each of image forming engines that successively form respective color images corresponding to a raster image on continuous paper is controlled to form an image position recognition pattern at an end of the continuous paper transported through each of the image forming engines, the displacement between the formation position of each image position recognition pattern and an ideal position is calculated, and then the operation of each image forming engine is subjected to predetermined registration displacement adjusting control so that the calculated displacement amount is reduced.

A second feature is as follows. A user himself/herself manually sets a first permissible value for the displacement amount when strict coincidence is required to the formation positions of the respective color images, and a second permissible value for the displacement amount when the coincidence requirement is more moderate than the first permissible value, and the image forming apparatus is allowed to operate in each of two modes, that is, a normal mode in which image formation is not carried out until the displacement amount is equal to the first permissible value or less, and a useless paper saving mode in which image formation is carried out at the time when the displacement amount is equal to the second permissible value or less.

A third feature is as follows. In the useless paper saving mode, a mark indicating that it is output in the process of temporary adjustment of registration displacement (hereinafter referred to as "temporary adjustment mark") is formed on continuous paper together with each color image during the time period from the time when the displacement amount between the formation position of the image position recognition pattern and the ideal position is reduced to the second permissible value or less till the time when the displacement amount reaches the first permissible amount.

Figure 1:
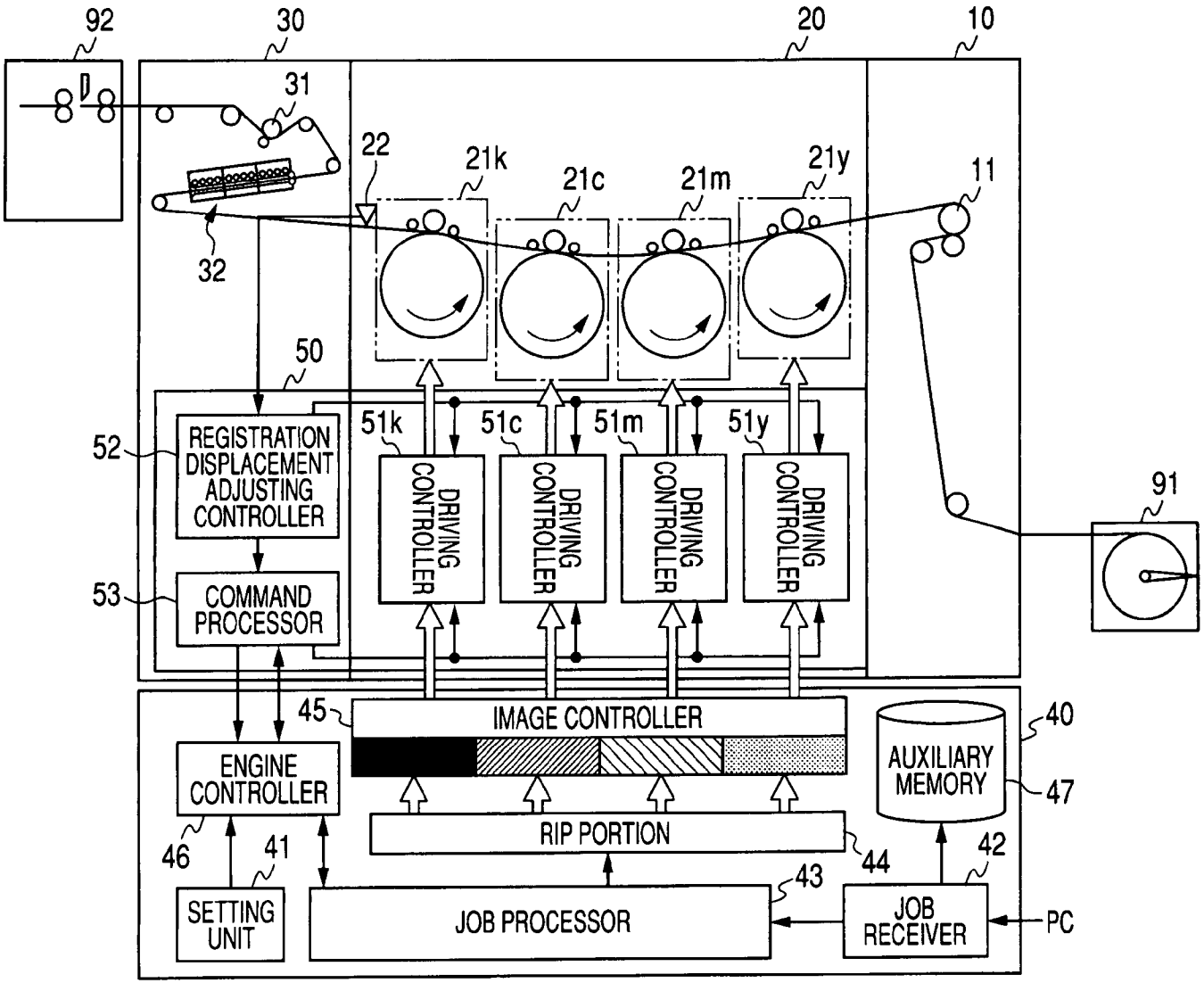
FIG. 1 is a diagram showing the construction of an image forming apparatus.

FIG. 1 is a block diagram showing the construction of the image forming apparatus according to this exemplary embodiment. As shown in FIG. 1, the image forming apparatus includes a feed-in unit 10, an image forming unit 20, a fixing unit 30, a main control unit 40 and an engine control unit 50.

The feed-in unit 10 has plural rollers containing a first driving roller 11. Continuous paper accommodated in a stacker 91 is suspended among respective rollers of the feed-in unit 10. When the first driving roller 11 is rotated, the continuous paper lead to the respective rollers containing the first driving roller 11 is fed into the image forming unit 20.

The image forming unit 20 includes image forming engines 21 (*y, m, c, k*) that are arranged along the transport path of the continuous paper and correspond to the respective colors of yellow, magenta, cyan and black, and a registration adjusting sensor 22 disposed at the downstream side of the image forming engines 21. Each image forming unit 20 forms a toner image of each color onto the continuous paper that is transported from the feed-in unit 10 through each image forming unit 20 to the fixing unit 30. The registration adjusting sensor 22 detects the respective formation positions of both the image position recognition patterns for detecting the displacement in the fast scan direction and also the displacement in the slow scan direction, the image position recognition patterns being successively formed at the end of the continuous paper when the continuous paper is passed through the respective image forming engines 21.

The hardware construction and operation of the image forming engine 21 will be described hereunder.

Figure 2:
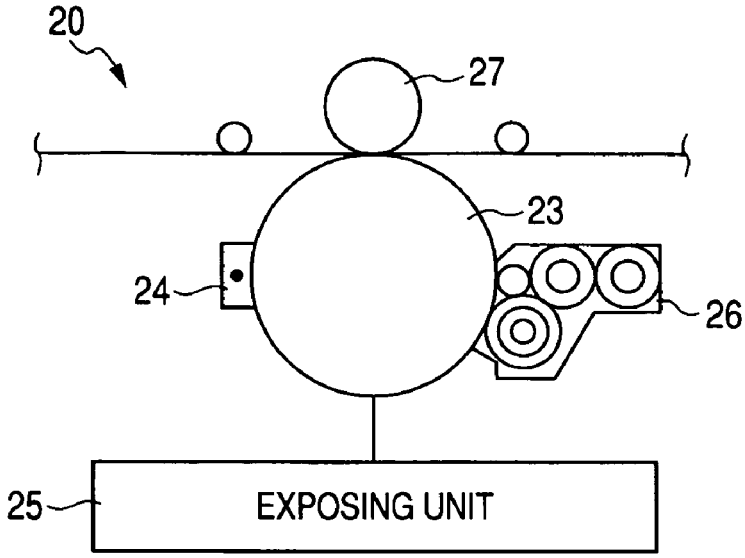
FIG. 2 is a diagram showing the hardware construction of an image forming engine.

FIG. 2 is a block diagram showing the hardware construction of the image forming engine 21. As shown in FIG. 2, each image forming unit 20 includes a photoconductive drum 23, and an electrifying unit 24, an exposure unit 25, a developing unit 26 and a transfer unit 27 which are disposed so as to surround the photoconductive drum 23, and these elements are driven in cooperation with one another in response to a driving signal supplied from a driving controller 51 of an engine control unit 50 described later.

The driving operation of each of the above units will be described. First, the electrifying unit 24 uniformly electrifies the peripheral surface of the photoconductive drum 23 rotating at a predetermined speed so that the potential of the peripheral surface of the photoconductive drum 23 is set to a predetermined potential (for example, −500V).

When the peripheral surface of the photoconductive drum 23 is electrified, the exposure unit 25 irradiates a laser beam onto the peripheral surface while scanning the peripheral surface. Here, the driving principle of the exposure unit 25 will be described in detail.

Figure 3:
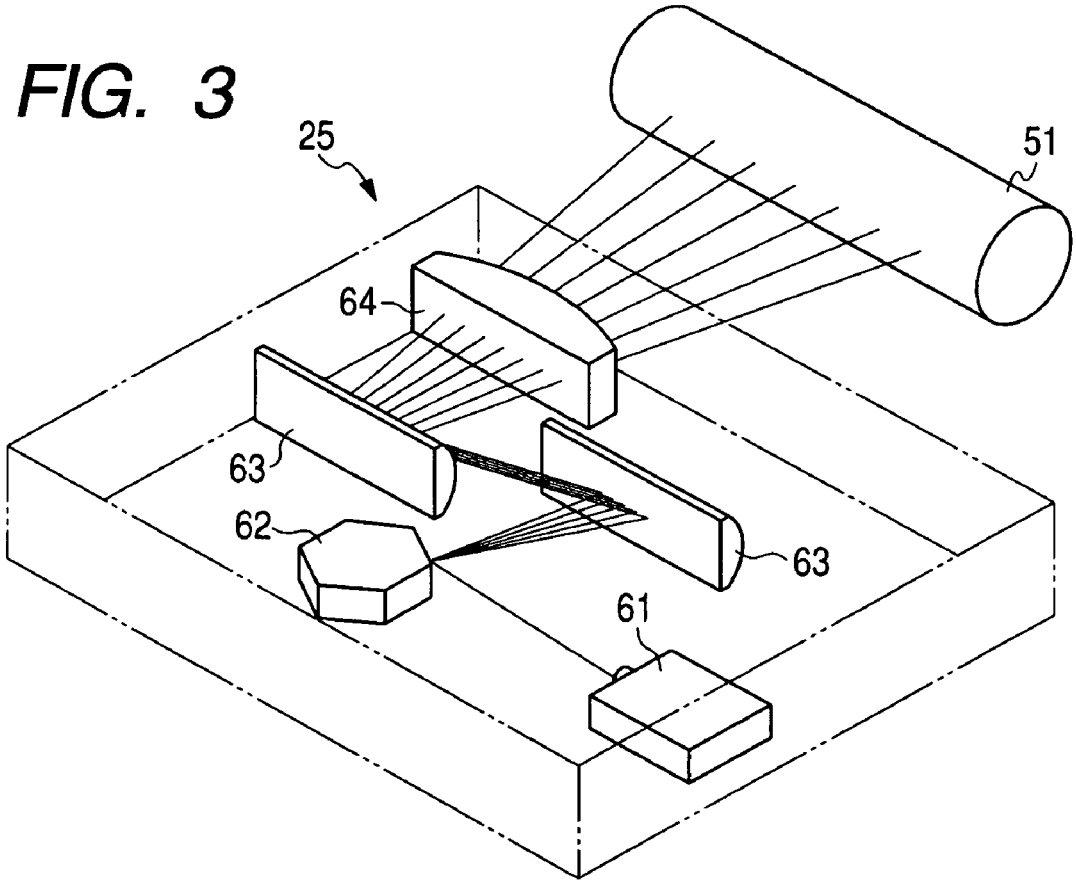
FIG. 3 is a diagram showing the details of the construction of an exposing unit.

FIG. 3 is a diagram showing the details of the construction of the exposure unit 25. The exposure unit 25 has a laser diode 61, a polygon mirror 62, a reflection mirror 63, an fθ lens 64, etc. A laser beam whose light intensity is modulated under the control of ROS (Raster output scanner) (not shown) is irradiated from the laser diode 61 to the polygon mirror 62. The polygon mirror 62 has a hexagonal cylindrical shape having six substantially rectangular reflection faces which forms the outer wall of the polygon mirror 62, and it rotates around the rotational shaft mounted on a polygon motor (not shown). The polygon mirror 62 deflects the beam light through the outer wall while continuously varying the incident angle of the laser beam through the rotation of the polygon mirror 62 itself, and the deflected laser beam is irradiated through the fθ lens 64 onto the photoconductive drum 23 along the fast scan line. As a result, the potential of the area to which the laser beam is irradiated is increased, thereby forming an electrostatic latent image.

In FIG. 2, when the electrostatic latent image is formed on the peripheral surface of the photoconductive drum 23 through the exposure operation of the exposure unit 25, the developing unit 26 sprays toner and positively-charged carriers filled in a toner cartridge (not shown) to the peripheral surface of the photoconductive drum 23. Accordingly, the toner adheres to the light-exposure area of the photoconductive drum 23, and the electrostatic latent image is developed as a toner image. When the toner image is developed, the transfer unit 27 serving as a roller which pinches the continuous paper with the photoconductive drum 23 creates the potential difference between the potential of the peripheral surface of the photoconductive drum 23 and the potential of the peripheral surface of the transfer unit 27 itself, and the toner image on the photoconductive drum 23 which undergoes the action of the potential difference is transferred onto the lower surface of the continuous paper.

Referring to FIG. 1 again, the fixing unit 30 has plural rollers containing the second driving roller 31 and a fixing mechanism 32. The fixing mechanism 32 includes a heating roll having a heating source therein and a pressure roll, and the peripheral surface of the heating roll and the peripheral surface of the pressure roll are brought into contact with each other, thereby forming a nip portion. When the continuous paper on which each color toner image has been formed by each image forming engine 21 of the image forming unit 20 is transported from the image forming unit 20 into the nip portion, the these toner images undergoes the heating action of the heating roll and the pressurizing action of the pressure roll, and fixed onto the continuous paper.

The continuous paper which has been subjected to the fixing operation of the toner images and then fed out from the fixing unit 30 is separated every predetermined size such as A4 or the like by a burster 92, and output as image-formed cut sheets.

The main control unit 40 has a setting unit 41, a job receiver 42, a job processor 43, RIP (Raster Image Processor) 44, an image controller 45, an engine controller 46 and an auxiliary memory 47.

The setting unit 41 is an operator for setting the first permissible value and the second permissible value described above, and further setting one of the normal mode and the useless paper saving mode in which the image forming apparatus should be operated.

The job receiver 42 receives from an external personal computer PC an image forming job in which plural images to be formed on a recording material by the image forming apparatus of this exemplary embodiment are described in a page description language, and delivers the image forming job through the job processor 43 to the RIP portion 44. The job processor 43 supplies the engine controller 46 with a reception notification signal indicating that the image processing job is received and also indicating various kinds of attributes of the job.

The RIP portion 44 interprets the image processing job delivered from the job processor 43 to successively generate a set of respective color raster images of yellow, magenta, cyan and black. The respective sets of raster images thus generated are successively supplied to the image controller 45.

The image controller 45 has a memory for buffering each set of raster images supplied from the RIP portion 44, and the raster images buffered in the memory are successively supplied to each driving controller 51 under the control of a command processor 53.

The engine controller 46 is a module that plays a core role of this apparatus while cooperating with the command processor 53 of the engine control unit 50 through the communication of various kinds of commands. The details of the characteristic behavior of the engine controller 46 will be described later with reference to a flowchart.

The auxiliary memory 47 is a non-volatile memory mounted to store some of sets of raster images successively generated by the RIP unit 44.

The engine control unit 50 has the driving controllers 51 (*y, m, c, k*), a registration displacement adjusting controller 52 and the command processor 53.

Each of the driving controllers 51 makes a pair with the image forming engine 21 for each color, and supplies the image forming engine 21 with a driving signal for forming each color toner image corresponding to a raster image under the control of the registration displacement adjusting controller 52 and the command processor 53. This driving signal contains a driving signal for instructing start or stop of the rotation of the photoconductive drum 23 of the image forming engine 21, a driving signal for instructing electrification of the electrifying unit 24, the developing unit 26 and the transfer portion 27, and also a driving signal for indicating the light irradiation timing of the diode 61 of the exposure unit 25 and the light amount thereof.

The registration displacement adjusting controller 52 feeds back the detection result of the registration adjusting sensor 22 to the driving of each image forming engine 21 through the driving controller 51, thereby performing the registration displacement adjusting control.

The registration displacement adjusting control of the registration displacement adjusting controller 52 will be briefly described below.

Figure 4:
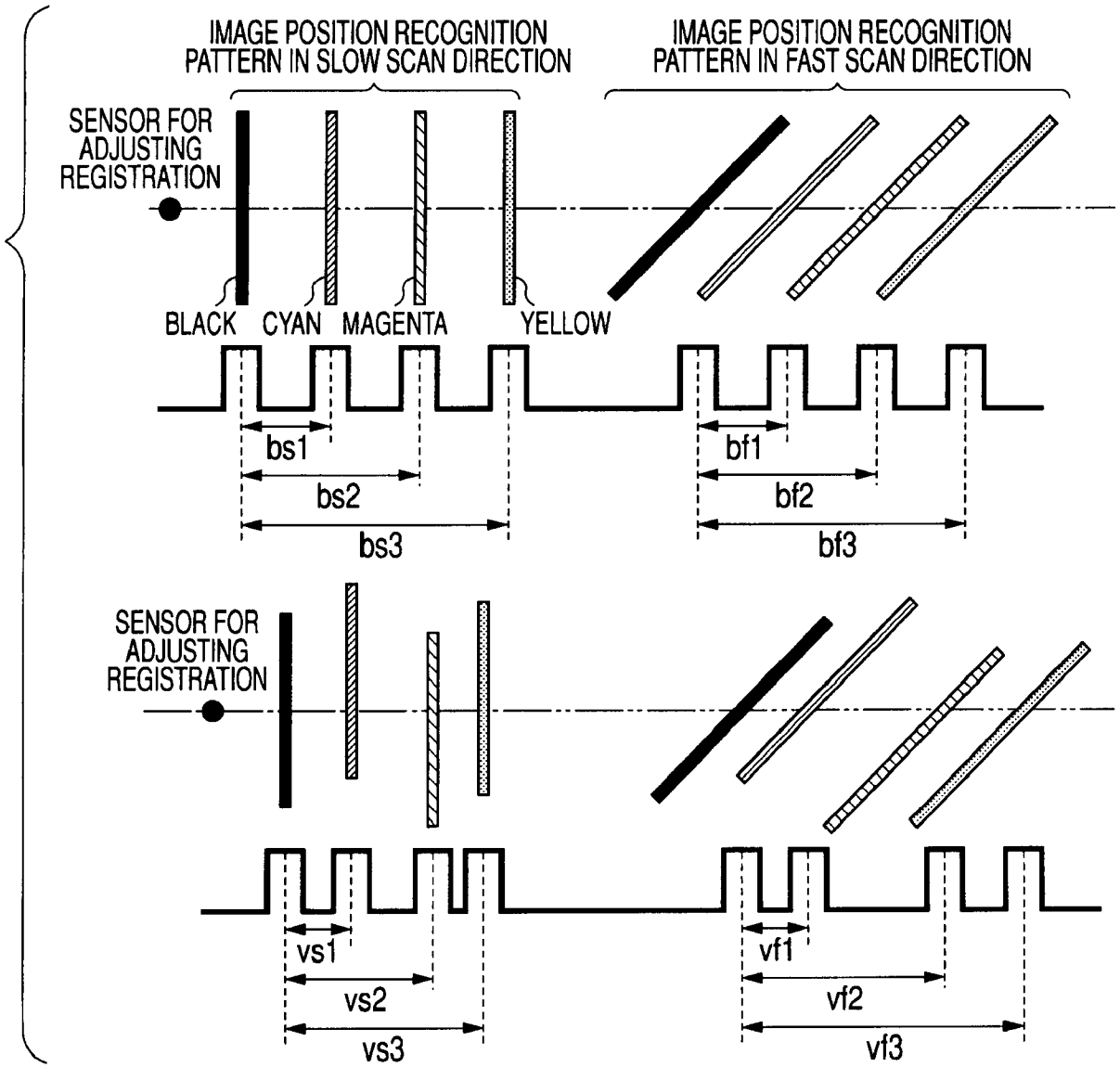
FIG. 4 is a diagram showing an image position recognition pattern.

First, as shown in FIG. 4, the formation positions of both the image position recognition patterns that are formed by the black image forming engine 21*k* and used to detect the registration displacement in the fast scan direction and the registration displacement in the slow scan direction are set as reference positions. Here, the ideal distance between each reference position and the formation position of each of three other color image position recognition patterns (hereinafter referred to as "ideal distance") bs (bs1, bs2, bs3), bf (bf1, bf2, bf3), and the actual distance thereof calculated from the detection result of the sensor (hereinafter referred to as "actual distance") vs (vs1, vs2, vs3), vf (vf1, vf2, vf3) are specified.

In FIG. 4, the ideal distance between the image position recognition patterns of black and cyan in the slow scan direction is represented by bs1, the ideal distance between the image position recognition patterns of black and magenta in the slow scan direction is represented by bs2, and the ideal distance between the image position recognition patterns of black and yellow in the slow scan direction is represented by bs3. Furthermore, the actual distance between the image position recognition patterns of black and cyan in the slow scan direction is represented by vs1, the actual distance between the image position recognition patterns of black and magenta in the slow scan direction is represented by vs2, and the actual distance between the image position recognition patterns of black and yellow in the slow scan direction is represented by vs3. Still furthermore, the ideal distance between the image position recognition patterns of black and cyan in the fast scan direction is represented by bf 1, the ideal distance between the image position recognition patterns of black and magenta is represented by bf2, and the actual distance between the image position recognition patterns of black and yellow is represented by bf3. Still furthermore, the actual distance between the image position recognition patterns of black and cyan in the fast scan direction is represented by vf1, the actual distance between the image position recognition patterns of black and magenta in the fast scan direction is represented by vf2, and the actual distance between the image position recognition patterns of black and yellow in the fast scan direction is represented by vf3.

After the ideal distance and the actual distance shown in FIG. 4 are specified, the difference between these distances for each color is calculated as an adjustment value in each of the fast scan direction and the slow scan direction. When the adjustment value in the slow scan direction of cyan is represented by adj1, the adjustment value in the slow scan direction of magenta is represented by adj2, the adjustment value in the slow scan direction of yellow is represented by adj3, the adjustment value in the fast scan direction of cyan is represented by adj4, the adjustment value in the fast scan direction of magenta is represented by adj5, and the adjustment value in the fast scan direction of yellow is represented by adj6, the adjustment values adj1 to adj6 are calculated according to the following calculation equations (1) to (6):

$$adj1=vs1-bs1 \quad (1)$$

$$adj2=vs2-bs2 \quad (2)$$

$$adj3=vs3-bs3 \quad (3)$$

$$adj4=vf1-bf1 \quad (4)$$

$$adj5=vf2-bf2 \quad (5)$$

$$adj6=vf3-bf3 \quad (6)$$

The adjustment values adj1 to adj6 in the fast scan direction and the slow scan direction of cyan, magenta and yellow are supplied to the driving controllers 51 as adjustment value signals. The driving controller 51 supplied with the adjustment value signal corrects the driving signal to be subsequently supplied to the image forming engine 21 according to the adjustment value indicated by the signal concerned. For example, when an adjustment value for adjusting any one of the displacement in the fast scan direction of the image forming engine 21 for some color is supplied, the driving controller 51 supplies a driving signal that advances or delays the irradiation timing of the diode of the exposure unit 25 of the image forming engine 21 for the color concerned by the amount corresponding to only the number of pixels indicated by the adjustment value. When an adjustment value for adjusting the displacement in the slow scan direction is supplied, the driving controller 51 supplies a driving signal that advances or delays the irradiation timing of the diode of the exposure unit 25 of the image forming engine 21 for the color concerned by the amount corresponding to only the number of lines of pixels indicated by the adjustment value.

Furthermore, the registration displacement adjusting controller 52 supplies the command processor 53 with the adjusting value signals indicating the respective adjustment values adj1 to adj6 achieved by the registration displacement adjusting controller 52 itself.

The command processor 53 controls the operation of the first driving roller 11, the second driving roller 31, the image controller 45 and each driving controller 51 according to various kinds of commands supplied from the engine controller 46.

The operation of this exemplary embodiment will be described. As described above, the image forming apparatus of this exemplary embodiment carries out different operations between the useless paper saving mode and the normal mode.

Figure 5:
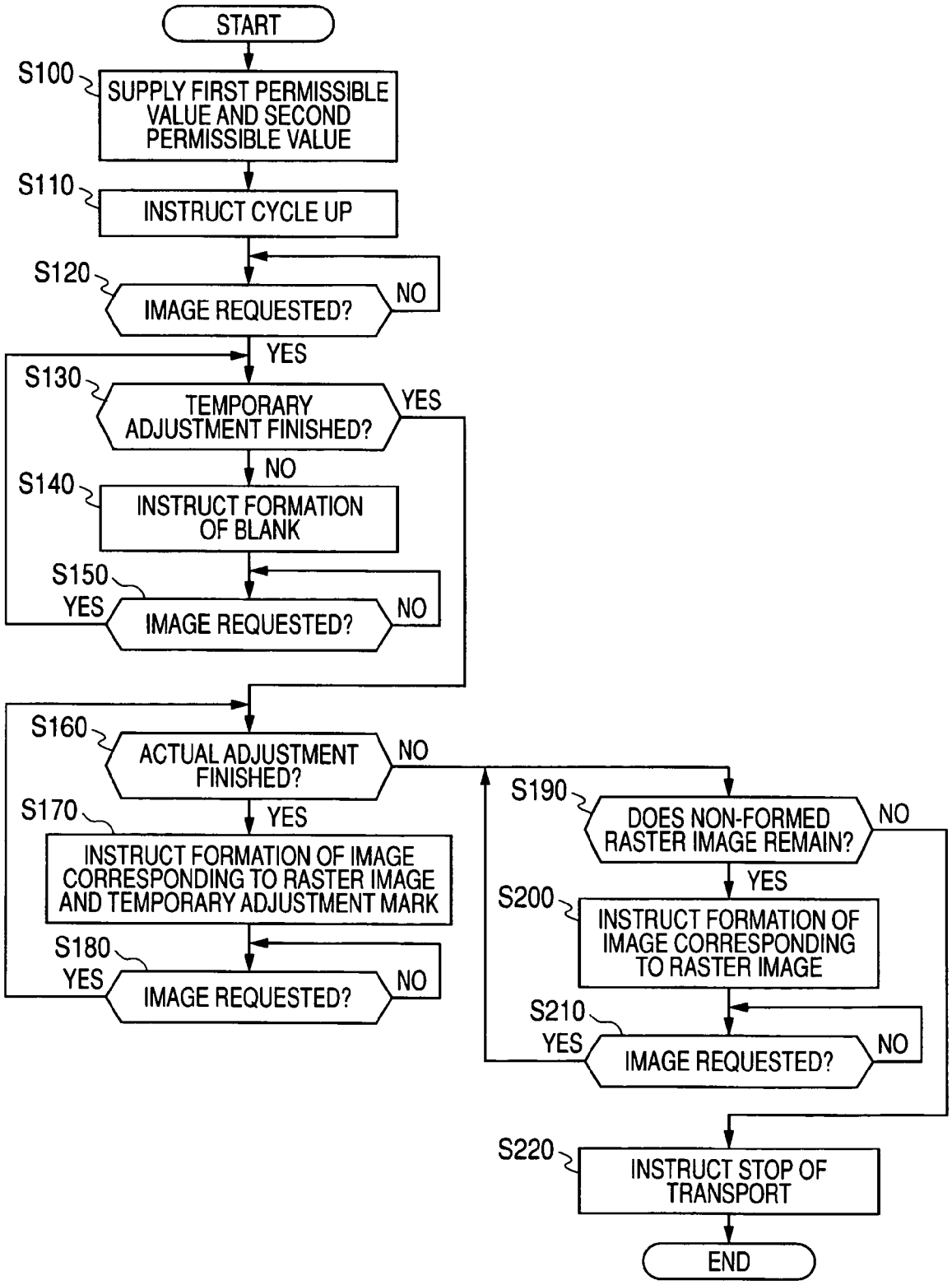
FIG. 5 is a diagram showing the processing of an engine controller.
Figure 6:
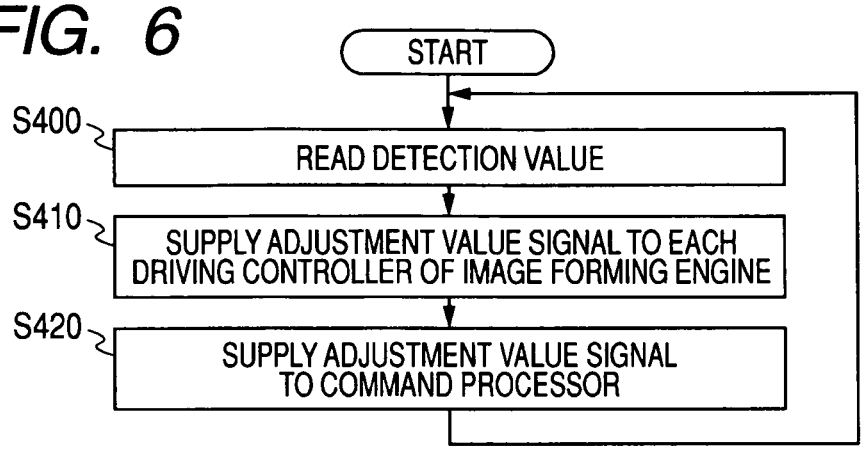
FIG. 6 is a diagram showing the processing of a registration displacement controller.
Figure 7:
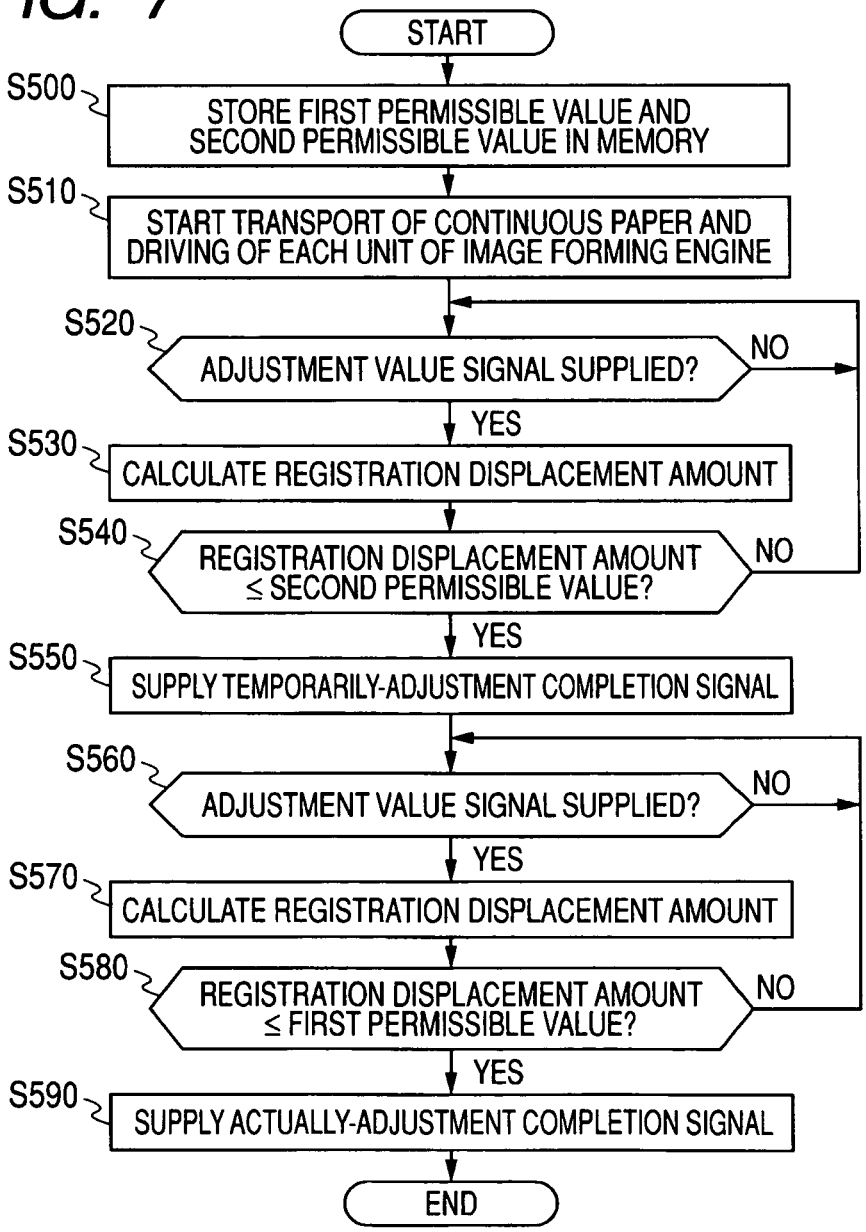
FIG. 7 is a diagram showing the processing of a command processor.

First, the operation of the useless paper saving mode will be described. FIGS. 5, 6, and 7 are flowcharts showing the operation of the useless paper saving mode, FIG. 5 shows the processing of the engine controller 46, FIG. 6 shows the processing of the registration displacement adjusting controller 52, and FIG. 7 shows the processing of the command processor 53.

In the useless paper saving mode, a new image forming job is delivered from the job receiver 42 to the job processor 43, and the engine controller 46 supplied with a reception notification signal from the job processor 43 supplies the command processor 53 with a permissible value setting signal indicating the first permissible value and the second permissible value set in the setting unit 41 (S100 of FIG. 5). The command processor 53 supplied with the permissible value setting signal stores into the memory thereof the first permissible value and the second permissible value which are indicated by the permissible value setting signal concerned (S500 of FIG. 7). In parallel to these processing, the RIP portion 44 starts to successively buffer into the memory of the image controller 45 each set of raster images which are achieved by interpreting the image forming job delivered from the job processor 43.

The engine controller 46 supplies the command processor 53 with a command for instructing the cycle-up (rotation) of the first driving roller 11 and the second driving roller 31 (S110 of FIG. 5). The command processor 53 supplied with the command starts to transport the continuous paper by cycling up the first driving roller 11 and the second driving roller 31, and also starts the driving of each unit by supplying the driving signal to each image forming engine 21 through the driving controller 51 (S510 of FIG. 7). The command processor 53 starting the transport of the continuous paper monitors the speed of the transport by a speed sensor (not shown), and after the transport speed reaches a predetermined stable speed, the command processor 53 continues to supply the engine controller 46 with an image request signal indicating readiness of formation of the image corresponding to a raster image every predetermined clock cycle.

Here, no raster image is supplied from the image controller 45 to each image forming engine 21 for a while after the driving of each unit of the image forming engine 21 is started in step 510 of FIG. 7. Therefore, each engine 21 cannot form a toner image, and only a position recognition pattern is successively formed at the end of the continuous paper passing through each unit. When the formation positions of these image position recognition patterns are detected by the registration adjusting sensor 22, the registration displacement adjusting control of the registration displacement adjusting controller 52 is carried out according to the procedure described above.

That is, the formation positions of the respective position recognition patterns are detected by the registration adjusting sensor 22, the detection values thus achieved are read in (S400 of FIG. 6). Then, these detection values are applied to the calculation equations (1) to (6) to achieve the adjustment values adj1 to adj6, and the adjustment value signals corresponding to these adjustment values are supplied to the respective driving controllers 51, whereby the driving signals supplied to the image forming engines 21 are adjusted (S410). Furthermore, these adjusting value signals are also supplied to the command processor 53 (S420). These series of operations of the steps 400 to 420 are repeated every clock cycle at which the registration adjusting sensor 22 detects the formation position of the image position forming pattern.

The command processor 53 which starts the transport of the continuous paper and the driving of each unit of the image forming engine 21 in step 510 of FIG. 7 waits for supply of the adjusting value signal from the registration displacement adjusting controller 52 (S520). When the adjusting value signal is supplied, the command processor 53 applies the adjustment values adj1 to adj6 indicated by the signal to the following calculation equation (7) to calculate a registration displacement amount n (S530).

$$n = \sum adj_i^2 (1 \le i \le 6) \tag{7}$$

The command processor 53 calculating the registration displacement amount n judges whether the registration displacement amount n is reduced to the second permissible value or less which is stored in the memory thereof (S540). If it is judged in step 540 that the registration displacement amount n is not equal to the second permissible value or less, the command processor 53 returns to the step 520 to waits for supply of a new adjusting value signal from the registration adjusting controller 52 at the next clock cycle. Furthermore, when judging that the registration displacement amount n is equal to the second permissible value or less, the command processor 53 supplies the engine controller 46 with a temporary-adjustment completion signal indicating the above judgment (S550), and then waits for supply of a new adjustment value signal from the registration displacement adjusting controller 52 at the next clock cycle (S560).

Then, when the adjustment value signal is supplied, the command processor 53 applies the adjustment values adj1 to adj6 indicated by the signal concerned to the above calculation equation (7) to calculate the registration displacement amount n again (S570), and judges whether the calculated registration displacement amount n is equal to the first permissible value or less which is stored in the memory thereof (S580). If it is judged in step S580 that the registration displacement amount n is not equal to the first permissible value or less, the command processor 53 returns to the step S560 to wait for supply of a new adjusting value signal from the registration displacement controller 52 at the next clock cycle. If it is judged that the registration displacement amount n is equal to the first permissible value or less, the command processor 53 supplies the engine controller 46 with an actual-adjustment completion signal indicating this judgment (S590).

The engine controller 46 supplying the command processor 53 with the command in step 120 of FIG. 5 waits for supply of an image request signal from the command processor 53 (S120).

When the image request signal is supplied, the engine controller 46 judges whether the temporary-adjustment completion signal is supplied from the command processor 53 (S130).

If it is judged in step 130 that no temporary-adjustment completion signal is supplied, the engine controller 46 supplies the command processor 53 with a command instructing formation of an blank image (step S140), and then waits for supply of a new image request signal from the command processor 53 (S150). When the new image request signal is supplied, the engine controller 46 returns to the step S130 to make the above judgment again. Accordingly, the processing from the step 140 to S150 is repeated while the judgment result of the step 130 is negative, and thus each image forming engine 21 cannot form any toner image of each color onto the continuous paper, and forms only an image position forming pattern at the end of the continuous paper. The routines of FIGS. 6 and 7 are repeated with the detection of the image position forming patterns of the registration adjusting sensor 22 as a trigger.

If it is judged in step 130 that a temporary-adjustment completion signal is supplied, the engine controller 46 judges whether an actual-adjustment completion signal is supplied from the command processor 53 (S160).

If it is judged in step 160 that the actual-adjustment completion signal is supplied, the engine controller 46 supplies the command processor 53 with a command instructing formation of each color image corresponding to a raster image and a temporary adjustment mark (S170). The command processor 53 receiving this command supplies each driving controller 51 with one set of raster images buffered in the memory of the image controller 45, and further supplies a driving signal for forming the respective color images corresponding to the raster images and a temporary adjustment mark from each driving controller 51 to each image forming engine 21.

Upon receiving this driving signal, the image forming engine 21 successively forms each color toner image corresponding to the raster image and the temporary adjustment mark on the continuous paper passing through the above units. The continuous paper on which the toner images and the temporary marks are formed is fixed in the fixing mechanism 32, separated by the burster 92 and then discharged as image-formed cut sheets. Accordingly, there is achieved a cut sheet on which the respective color toner images are superposed on one another with a registration displacement amount which is not less than the first permissible value, but less than the second permissible value, and also the temporary adjustment mark is formed at a predetermined position of the end of the cut sheet.

Furthermore, the engine controller 46 stores the set of raster images supplied to the engine controller 46 into the auxiliary memory 47 in this step.

The engine controller 46 supplying the command in step 170 waits for supply of a new image request signal from the command processor 53 (S180), and returns to the step 160 to make a judgment again when the new image request signal is supplied.

If it is judged in step 160 that the actual-adjustment completion signal is supplied, the engine controller 46 judges whether there remains any set of raster images which are buffered in the memory of the image controller 45 and have not yet been subjected to image formation (S190). When all the sets of raster images generated by interpreting the image forming job through the RIP unit 44 have been supplied to the engine controller 46 and the job has been completed, or when the generation of raster images by the RIP unit 44 stagnates and thus buffering is delayed, the judgment result of this step becomes positive. If not so, the judgment becomes negative.

If it is judged in step 190 that there remains some set of raster images buffered in the memory of the image controller 45, the engine controller 46 supplies the command processor 53 with a command instructing formation of the images corresponding to the raster images (S200). That is, in this step, the command supplied to the command processor 53 does not instruct formation of a toner image and a temporary adjustment mark, but it instructs formation of only a toner image.

The command processor 53 receiving this command supplies each driving controller 51 with one set of raster images buffered in the memory of the image controller 45, and further supplies a driving signal for forming the raster images as respective color tone images from each driving controller 51 to each image forming engine 21.

Upon receiving this driving signal, the image forming engines 21 successively form the respective color toner images corresponding to the raster images on the continuous paper passing through the above units, and the continuous paper on which the toner images are formed is fixed by the fixing mechanism 32, separated by the burster and then discharged as an image-formed cut sheet. Accordingly, there can be achieved a cut sheet on which the respective color toner images are superposed on one another with a minute registration displacement amount which is not more than the first permissible value.

The engine controller 46 supplying the command in step 200 waits for supply of a new image request signal from the command processor 53 (S210), and when the new image request signal is supplied, the engine controller 46 returns to the step 190 to make a judgment again.

If it is judged in step 190 that there does not remain any set of raster images buffered in the memory of the image controller 45, the engine controller 46 supplies the command processor 53 with a command instructing stop of the transport of the continuous paper (S220).

The command processor 53 receiving the command stops the driving of the first driving roller 11 and the second driving roller 31, and thus the transport of the continuous paper is also stopped. When the job receiver 42 receives a new image processing job, the processing of the step 110 and the subsequent steps is repeated.

When the processing goes to step 220 without completing the image forming job because the generation of the raster images by the RIP unit 44 stagnates and thus the rotation of the driving roller is stopped, the processing is executed from the step 100 at the time when the stagnation is recovered and raster images are buffered into the memory. In such a case, the first driving roller 11 and the second driving roller 31 must be cycled up from the time when the transport of the continuous paper is stopped till the time when the transport speed of the continuous paper reaches a predetermined stable speed, and it is necessary to carry out image formation after registration displacement unavoidably occurring in the process of retrying the cycle-up is overcome.

Next, the operation of the normal mode will be described.

The operation of the normal mode belongs to the category of the well-known technique, and thus only the difference from the useless paper saving mode will be briefly described below.

In the normal mode, the processing from the step 130 to the step 150 shown in FIG. 5 and the processing from the step 520 to the step 550 shown in FIG. 7 are not executed. That is, it is not judged whether the registration displacement amount is reduced to the second permissible value or less. The engine controller 46 continues to supply the command processor 53 with a command instructing formation of a blank image until the registration displacement amount is reduced to the first permissible value or less. When the registration displacement amount is reduced to the first permissible value or less, the engine controller 46 supplies a command instructing formation of respective color images corresponding to raster images.

The difference between the operations of these modes will be described in more detail with reference to FIG. 8.

Figure 8:
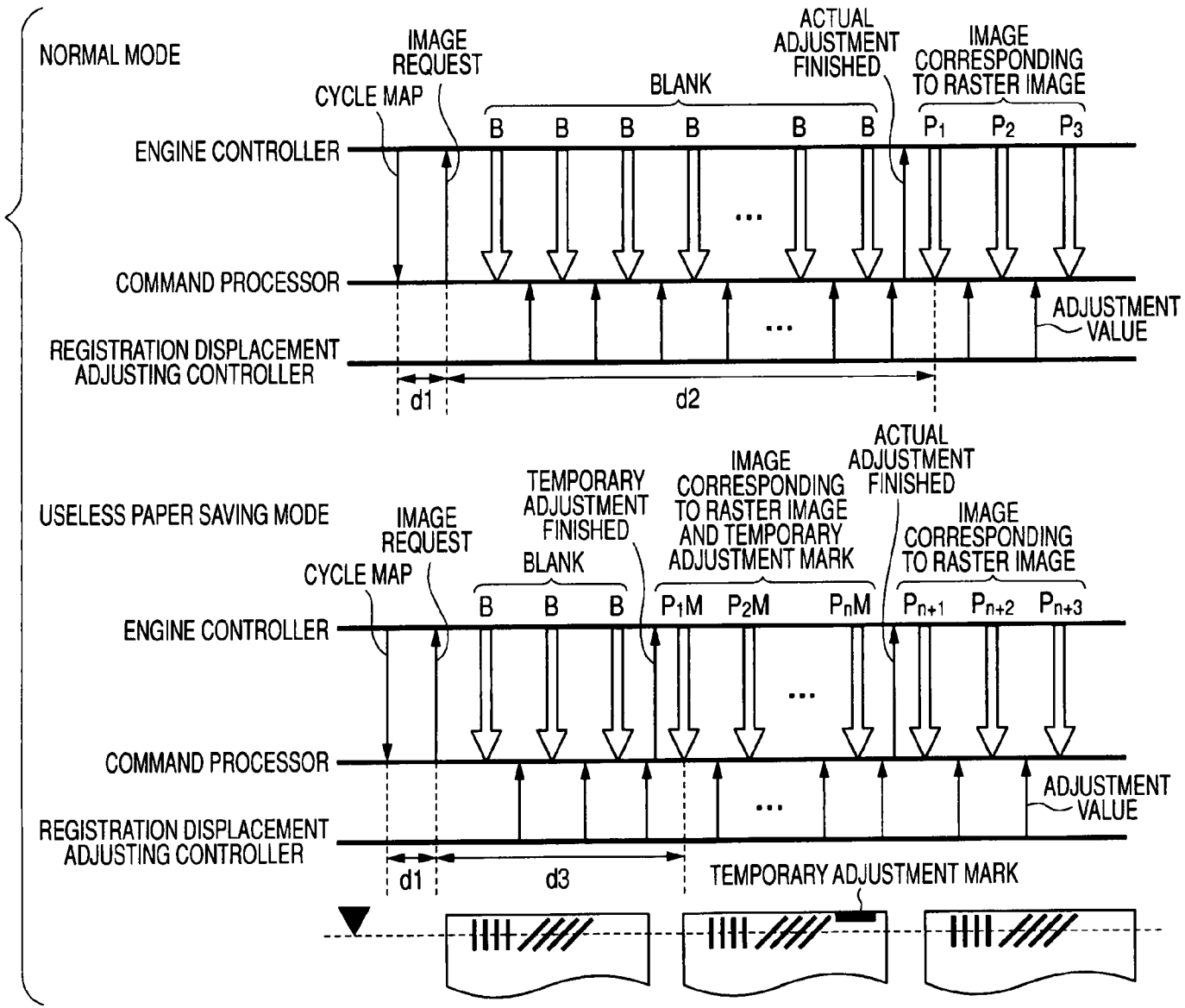
FIG. 8 is a diagram showing the difference between a normal mode and a useless paper saving mode.

FIG. 8 shows an example of the communication of commands and signals among the engine controller 46, the command processor 53 and the registration displacement adjusting controller 52 in each of the normal mode and the useless saving mode. The upper stage of FIG. 8 shows the communication of the commands and the signals in the normal mode, and the lower stage of FIG. 8 shows the communication of the commands and the signals in the useless paper saving mode.

At the upper stage of FIG. 8, in the normal mode, the engine controller 46 which supplies the command processor 53 with a command instructing the cycle-up (rotation) of the first driving roller 11 and the second driving roller 31 and receives an image request signal from the command processor 53 continues to supply the command processor 53 with a command B instructing formation of a blank image until the engine controller 46 receives an actual-adjustment completion signal from the command processor 53, and starts to supply commands P1, P2, P3 instructing formation of respective color images corresponding to raster images from the time when receiving the actual-adjustment completion signal. As a result, there occurs a useless paper area corresponding to the total of the distance d1 at which the transport speed of the continuous paper reaches a stable speed and the distance d2 at which the registration displacement amount is reduced to the first permissible value or less under the registration displacement adjusting control of the registration displacement adjusting controller 52.

On the other hand, in the useless paper saving mode, the engine controller 46 which supplies the command processor 53 with the command instructing the cycle-up (rotation) of the first driving roller 11 and the second driving roller 31 and receives an image request signal continues to supply the command processor 53 with the command B instructing formation of a blank image, and continues to supply the command processor 53 with commands P1M, P2M, P3M, . . . , PnM instructing formation of the respective color images corresponding to raster images and temporary adjustment marks from the time when the engine controller 46 receives the temporary-adjustment completion signal till the time when it receives the actual-adjustment completion signal. From the time when receiving the actual-adjustment completion signal, the engine controller 4.6 supplies commands Pn+1, Pn+2, Pn+3 instructing formation of the respective color images corresponding to the raster images.

As a result, there can be prevented occurrence of a useless paper area corresponding to the total of the distance d1 at which the speed of the continuous paper reaches a stable speed and the distance d3 at which the registration displacement amount is reduced to the second permissible value or less under the registration displacement adjusting control of the registration displacement adjusting controller 52. In addition, the temporary adjustment mark is formed at the predetermined position of the end of an original output from the time when the registration displacement amount is reduced to the second permissible value or less till the time when the registration displacement amount reaches the first permissible value. The set of raster images providing the temporary adjusting mark is stored in the auxiliary memory 47. Therefore, the set of raster image can be output again at the time point when the image forming apparatus is operated in the normal mode and the registration displacement control is executed until the registration displacement amount is reduced to the first permissible value.

In the exemplary embodiment described above, the user is allowed to manually set the first permissible value of the registration displacement amount when the formation positions of the respective color images are strictly coincident with one another, and the second permissible value of the registration displacement amount when the formation positions of the respective color images are more loosely coincident with one another (i.e., it is unnecessary to make the formation positions concerned strictly coincident with one another at the same level as the first permissible value). In the useless paper saving mode, during the time period from the time when the displacement between the formation position of the image position recognition pattern and the ideal position thereof is reduced to the second permissible value or less till it reaches the first permissible value, the temporary adjustment mark for indicating that it is output in the progress of the temporary adjustment operation for the registration displacement is formed on the continuous paper together with each color image. Furthermore, the raster images causing the formation of the temporary adjustment mark concerned is stored in the auxiliary memory 40, and it can be output again at the time point when the registration displacement adjusting control is executed until the registration displacement amount is reduced to the first permissible value or less. Accordingly, when an original requiring strict coincidence is output, the normal mode is used. On the other hand, when an original which does not require strict coincident is output, the useless paper saving mode is used. Accordingly, the amount of useless paper which unavoidably occurs in connection with the registration displacement adjusting control can be suppressed to the minimum level.

(Modifications)

For example, the following modifications may be made. In the above exemplary embodiment, the command processor 53 supplied with the adjusting value signals of the adjusting values adj1 to adj6 from the registration displacement adjusting controller 52 calculates the registration displacement amount from the adjustment values adj1 to adj6 indicated by the adjustment value signal. However, the registration displacement adjusting controller 52 itself may calculate the registration displacement amount, and supply a signal indicating the calculated registration displacement amount to the command processor 53. In this modification, the command processor 53 receiving the supply of the signal indicating the registration displacement amount from the registration displacement adjusting controller 52 judges whether the registration displacement amount indicated by the signal is reduced to the second permissible value, further the first permissible value or less.

In the above embodiment, the substantially rectangular temporary adjustment mark is formed at the end of the continuous paper. However, the temporary adjustment mark is not required to be substantially rectangular insofar as it can be identified as being output in the progress of the temporary adjustment operation. Furthermore, it is not required to be formed at the end of the continuous paper insofar as it is located so as not to be overlapped with the toner images corresponding to the raster images.

The user may be allowed to select a re-output set of raster images by the setting unit 41 from the respective sets of raster images stored in the auxiliary memory 47. In this modification, when a set of raster images to be re-output is selected through the setting unit 41, the raster images are read out from the auxiliary memory 47 and buffered into the memory of the image controller 45. Under this state, the registration displacement adjusting control is executed, and the raster images are supplied from the memory to the respective driving controllers 51 at the time point when the registration displacement amount is reduced to the first permissible value or less.

In the above embodiment, each of the image forming engines 21 for yellow, magenta, cyan and black colors forms a temporary adjustment mark on continuous paper. However, only the image forming engine 21 for at least one of the colors (for example, the image forming engine 21 for black) may form a temporary adjustment mark.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an input unit that inputs an image forming job;

a raster image generating unit that interprets the input image forming job and successively generates a set of raster images of respective colors;

a transport path along which continuous paper is transported;

a plurality of image forming engines each of which is individually driven in accordance with a driving signal supplied thereto to successively form each color image on a surface of the continuous paper transported along the transport path and form a pattern indicating a position as a reference for image formation so that the pattern is not overlapped with the image;

a calculating unit that calculates displacement amount between the formation position of the pattern formed by each image forming engine and an ideal formation position thereof; and a controller that (1) supplies each of the plurality of image forming engines with a driving signal instructing formation of a blank image when the calculated displacement amount is larger than a second threshold value, (2) supplies each of the plurality of image forming engines with a driving signal instructing formation of the image corresponding to each raster image generated by the raster image generating unit and a preset mark when the calculated displacement amount is smaller than the second threshold value, and (3) supplies each of the plurality of image forming engines with a driving signal instructing formation of only the image corresponding to each raster image generated by the raster image generating unit when the calculated displacement amount is smaller than a first threshold value, the first threshold value being smaller than the second threshold value.

2. The image forming apparatus according to claim 1, wherein the controller adjusts the driving signals to be supplied to some or all of the image forming engines so as to reduce the displacement amount calculated by the calculating unit.

3. The image forming apparatus according to claim 1, further comprising a memory that stores a set of raster images that cause formation of both the image and the mark by the plurality of image forming engines, whereby the controller reads out the set of raster images stored in the memory and supplies each of the plurality of image forming engines with a driving signal instructing formation of the image corresponding to each of the raster images constituting the readout set when the displacement amount calculated by the calculating unit is smaller than the first threshold value.

4. The image forming apparatus according to claim 3, further comprising an operator that selects a set of raster images to be re-output from respective sets of raster images stored in the memory, whereby the controller reads out the selected set of raster images by the operator.

5. The image forming apparatus according to claim 1, further comprising:

a stacker that accommodates the continuous paper;

a burster that separates the continuous paper; and a transport controller that leads the continuous paper accommodated in the stacker through the transport path to the burster.

6. A computer-readable medium, storing a program causing a computer having an input unit that inputs an image forming job, a transport path along which continuous paper is transported, and a plurality of image forming engines each of which is individually driven in accordance with a driving signal supplied thereto to successively form each color image on a surface of the continuous paper transported along the transport path and form a pattern indicating a position as a reference for image formation so that the pattern is not overlapped with the image, to execute a process comprising:

interpreting the input image forming job to generate a set of raster images of respective colors;

calculating a displacement amount between the formation position of a pattern formed by each of the image forming engines and an ideal forming position thereof; and supplying each of the plurality of image forming engines with (1) driving signal instructing formation of a blank image when the calculated displacement amount is larger than a second threshold value, (2) supplying each of the plurality of image forming engines with a driving signal instructing formation of the image corresponding to each raster image generated by the raster image generating unit and a preset mark when the calculated displacement amount is smaller than the second threshold value, and (3) supplying each of the plurality of image forming engines with a driving signal instructing formation of only the image corresponding to each raster image generated by the raster image generating unit when the displacement amount is smaller than a first threshold value, the first threshold value being smaller than the second threshold value.

7. The computer-readable medium according to claim 6, wherein: supplying each of the plurality of the image forming engines with the driving signal further includes adjusting the driving signal to be supplied to at least one of the image forming engines so as to reduce the displacement amount calculated by the calculating unit.

8. An image forming method using a computer having Input unit that inputs an image forming job, a transport path along which continuous paper is transported, and a plurality of image forming engines each of which is individually driven in accordance with a driving signal supplied thereto to successively form each color image on a surface of the continuous paper transported along the transport path and form a pattern indicating a position as a reference for image formation so that the pattern is not overlapped with the image, the image forming method comprising:

interpreting the input image forming job to generate a set of raster images of respective colors;

calculating a displacement amount between the formation position of a pattern formed by each of the image forming engines and an ideal forming position thereof; and supplying each of the plurality of image forming engines (1)a driving signal instructing formation of a blank image when the calculated displacement amount is larger than a second threshold value, (2) supplying each of the plurality of image forming engines with a driving signal instructing formation of the image corresponding to each raster image generated by the raster image generating unit and a preset mark when the calculated displacement amount is smaller than the second threshold value, and (3) supplying each of the plurality of image forming engines with a driving signal instructing formation of only the image corresponding to each raster image generated by the raster image generating unit when the displacement amount is smaller than a first threshold value, the first threshold value being smaller than the second threshold value.

9. The image forming method according to claim 8, wherein: supplying each of the plurality of the image forming engines with the driving signal further includes adjusting the driving signal to be supplied to at least one of the image forming engines so as to reduce the displacement amount calculated by the calculating unit.

* * * * *